US009265989B2

(12) United States Patent
Perner et al.

(10) Patent No.: US 9,265,989 B2
(45) Date of Patent: Feb. 23, 2016

(54) CONNECTING ADJUSTMENT ASSEMBLY

(71) Applicant: D B Industries, Inc., Red Wing, MN (US)

(72) Inventors: Judd J. Perner, Red Wing, MN (US); Clifford D. Petty, Mooresville, IN (US)

(73) Assignee: D B Industries, LLC, Red Wing, MN (US)

( * ) Notice: Subject to any disclaimer, the term of this patent is extended or adjusted under 35 U.S.C. 154(b) by 306 days.

(21) Appl. No.: 13/675,556

(22) Filed: Nov. 13, 2012

(65) Prior Publication Data

US 2013/0126269 A1 May 23, 2013

Related U.S. Application Data

(60) Provisional application No. 61/561,432, filed on Nov. 18, 2011.

(51) Int. Cl.

| | |
|---|---|
| ***A63B 27/00*** | (2006.01) |
| ***A63B 27/02*** | (2006.01) |
| ***A62B 35/00*** | (2006.01) |

(52) U.S. Cl.

CPC ..... *A63B 27/02* (2013.01); *A62B 35/0068* (2013.01); *A63B 27/00* (2013.01)

(58) Field of Classification Search

CPC ..... A62B 35/00; A62B 35/0075; A62B 35/0006; A62B 35/0068; A63B 27/00; A63B 27/02

USPC ..... 182/9; 24/307, 325, 163 R

See application file for complete search history.

(56) References Cited

U.S. PATENT DOCUMENTS

| | | | |
|---|---|---|---|
| 869,382 | A | 10/1907 | Newton |
| 1,344,955 | A | 6/1920 | Morse |
| 1,802,288 | A | 4/1929 | Strauss |
| 1,721,516 | A | 7/1929 | Jacobs |

(Continued)

FOREIGN PATENT DOCUMENTS

| | | |
|---|---|---|
| CA | 2676507 | 2/2010 |
| CA | 2681870 | 4/2010 |

(Continued)

OTHER PUBLICATIONS

Buckingham Manufacturing Co. Inc., Instructions/Warnings 483/484 Series—BuckSqueeze (Patented), 483.DOC (Rev. Jun. 22, 2010), Part #230095, 11 pages.

(Continued)

*Primary Examiner* — Colleen M Chavchavadze

(74) *Attorney, Agent, or Firm* — IPLM Group, P.A.

(57) ABSTRACT

A connecting adjustment assembly for a fall protection assembly including a back plate assembly and a sliding engagement member is provided. The back plate assembly includes a body and a roller. The body has a first side and an opposed second side. The body further has a first edge and an opposed second edge that defines the length of the body. The body also has a third edge and an opposed fourth edge that defines a width of the body. The body still further has a groove in the second side that passes along the width of the body. The roller is rotationally coupled proximate the second edge of the body. The sliding engagement member includes a first portion with a first post and a second portion with a connection head. The first post is configured and arranged to be at least partially received within the groove of the body.

16 Claims, 8 Drawing Sheets

(56) References Cited

U.S. PATENT DOCUMENTS

| | | | | | |
|---|---|---|---|---|---|
| 2,601,589 | A | * | 6/1952 | Childers, Sr. | 182/9 |
| 2,920,714 | A | | 1/1960 | Johnson | |
| 3,407,898 | A | | 10/1968 | Johnson | |
| 3,726,360 | A | | 4/1973 | Price et al. | |
| 3,743,050 | A | | 7/1973 | Danz | |
| 3,840,091 | A | | 10/1974 | Conlon | |
| 4,407,391 | A | | 10/1983 | Greenway et al. | |
| 4,527,660 | A | | 7/1985 | Andruchiw | |
| 4,579,196 | A | * | 4/1986 | Allen et al. | 182/9 |
| 4,595,078 | A | | 6/1986 | Greenway | |
| 4,712,646 | A | * | 12/1987 | Page | 182/9 |
| 4,747,468 | A | | 5/1988 | Greenway | |
| 5,050,704 | A | | 9/1991 | Olsson | |
| 5,137,113 | A | * | 8/1992 | Lortie | 182/9 |
| 5,141,074 | A | * | 8/1992 | Sulowski et al. | 182/9 |
| 5,184,696 | A | * | 2/1993 | Meed et al. | 182/9 |
| 5,222,991 | A | | 6/1993 | Bell | |
| 5,234,074 | A | | 8/1993 | Bell | |
| 5,906,873 | A | | 5/1999 | Kim | |
| 6,357,547 | B1 | | 3/2002 | Kellog et al. | |
| 6,581,726 | B1 | | 6/2003 | Petzl et al. | |
| 6,644,438 | B1 | * | 11/2003 | Chang et al. | 182/9 |
| 6,752,242 | B1 | | 6/2004 | Whitehead et al. | |
| 6,973,995 | B1 | | 12/2005 | Diggle, III et al. | |
| 7,100,738 | B1 | | 9/2006 | Diggle, III et al. | |
| 7,103,943 | B2 | | 9/2006 | Lambert | |
| D610,434 | S | | 2/2010 | Watts et al. | |
| 8,464,832 | B1 | | 6/2013 | Rullo | |
| 8,887,866 | B2 | * | 11/2014 | Petty et al. | 182/9 |
| 2004/0200666 | A1 | | 10/2004 | Diggle et al. | |
| 2005/0247521 | A1 | | 11/2005 | Diggle | |
| 2008/0148529 | A1 | | 6/2008 | Huang | |
| 2010/0051382 | A1 | | 3/2010 | Schlief | |
| 2010/0078261 | A1 | | 4/2010 | Watts et al. | |
| 2010/0089694 | A1 | | 4/2010 | Paul | |
| 2011/0214941 | A1 | * | 9/2011 | Petty et al. | 182/9 |
| 2011/0290586 | A1 | | 12/2011 | Goldmann, II et al. | |
| 2012/0205193 | A1 | | 8/2012 | Patel et al. | |
| 2012/0292129 | A1 | * | 11/2012 | Seman | 182/9 |

FOREIGN PATENT DOCUMENTS

| | | | |
|---|---|---|---|
| CN | 2912314 | | 6/2007 |
| CN | 2917360 | | 7/2007 |
| CN | 101564578 | | 10/2009 |
| CN | 202590203 | | 12/2012 |
| GB | 265542 | | 3/1927 |
| JP | 10-151214 | | 6/1998 |
| JP | 2003-070925 | | 3/2003 |
| WO | WO 2008/054041 | A1 | 5/2008 |
| WO | WO 2011/112517 | A2 | 9/2011 |

OTHER PUBLICATIONS

Buckingham Manufacturing Company, Inc., 483 D—BuckSqueeze for Distribution [online] [retrieved May 2, 2011] Retrieved from the Internet: http://www.buckinghammfg.com/index.cfm?fuseaction=product.display&product_ID=1167 &CFID=2309333&CFTOKEN=79970743>, 3 pages.

Buckingham Manufacturing Company, Inc. 9-8 BuckAdjuster [online] [retrieved May 2, 2011] Retrieved from the internet: <http://www.buckinghammfg.com/index.cfm?fuseaction=product.display &product_ID=2361&ParentCat=72>, 1 page.

Buckingham Manufacturing Company, Inc. Woven Nylon Positioning Strap with Friction Buckle [online] [retrieved May 2, 2011] Retrieved from the internet: <http://www.buckinghammfg.com/index.cfm?fuseaction=category.display&catagory_ID=334>, 2 pages.

Huntsville Choker image, Fall Protection in Ontario, Fall Restrict Devices for Wood Pole Climbing. Date unknown, 3 pages.

International Search Report for PCT/US2011/027413 mailed Sep. 9, 2011.

J.E. Lortie Jelco, Pole Choker Standard Features, The Pole Choker Specifications for Pole Choker 3, Pole Choker 4, Pole Choker 5, Pole Choker 6 [online] Date unknown, Retrieved online: sales@jelco-alubox.com>, 2 pages.

Jelco Co. Ltd., Pole Choker™ 5 [online] [retrieved May 2, 2011] Retrieved from the internet: <http://www.jelco.ca/en/index.php>, 2 pages.

Klein Tools-Pole Master™, Lineman's Climbing Equipment & Harnesses, FPD-5295, [online], [retrieved May 2, 2011] Retrieved from the Internet: http://www.service.kleintools.com/cgi-bin/lansaweb?procfun+KD01+KD01025+PRD+ENG+FUNCPARMS+KD01YYCTN(P0020):2+KD01YYPRD(A0150):FPD-5295>, 1 page.

Petzl Lanyards and Energy Absorbers, Grillon Hook [online] [retrieved May 2, 2011] Retrieved from the internet: <http://www.petzl.com/en/pro/lanyards-and-energy-absorbers>, 3 pages.

International Partial Search Report from PCT Application No. PCT/US2011/027413, mailed Jul. 14, 2011.

Scepter, SPS—2000 PoleShark [online] [retrieved May 2, 2011] Retrieved from the internet: <http://www.poleshark.com/products/sps_2000>, 2 pages.

Scepter, Instructions on how to properly use your PoleShark 3000 [online] [retrieved May 2, 2011] Retrieved from the internet: <http//www.poleshark.com/instructions/>, 1 page.

Minseal, Mineral Seal Corporation, Ceramic Fiber Net, "CereTex Ceramic Fiber Cloth", 2008 [online], <http://www.ceramicfiber.net/ceramicfibercloth.htm> 1 page.

Office Action for U.S. Appl. No. 13/032,331, mailed Oct. 10, 2013.

PCT International Search Report for Application PCT/US2012/065155 mailed Jul. 22, 2013 5 pages.

First Office Action for related Chinese Patent Application No. 2012800669804 (Connecting Adjustment Assembly) mailed Aug. 25, 2015, 15 pages.

* cited by examiner

FIG. 5A
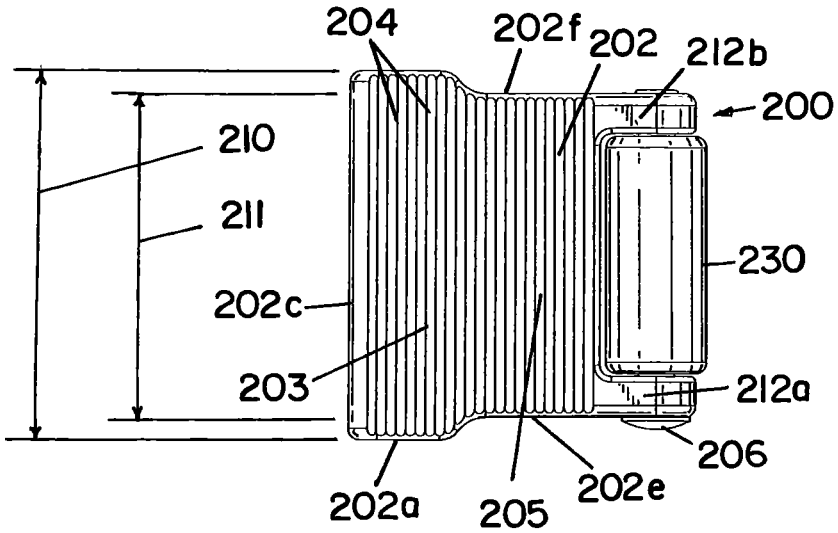
FIG. 5B
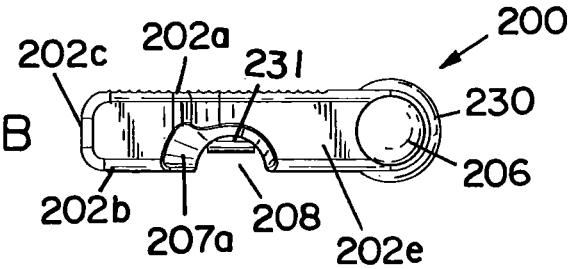
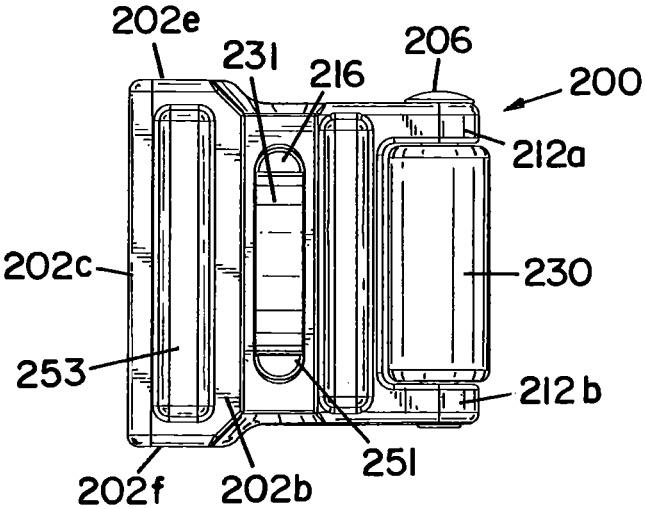
FIG. 5C

FIG. 5D
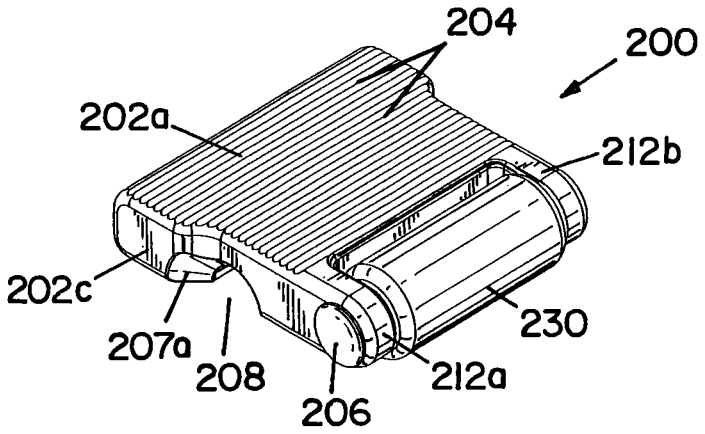
FIG. 5E
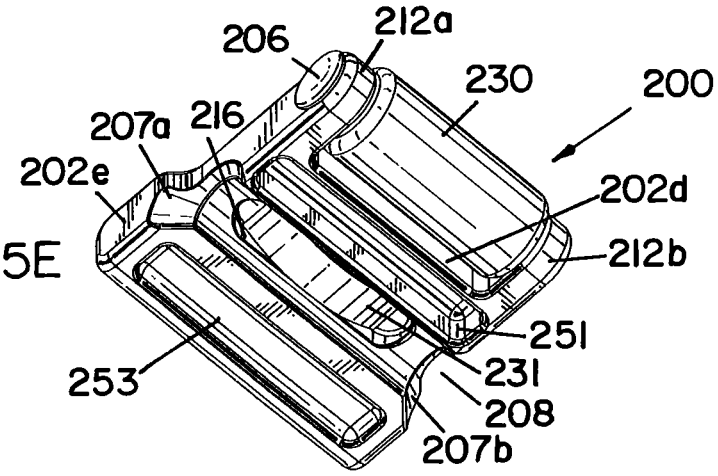
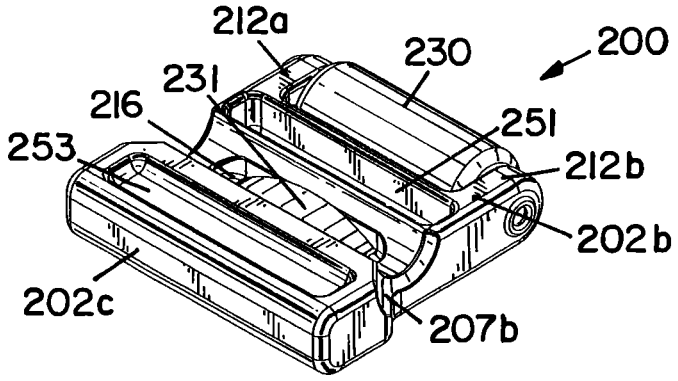
FIG. 5F

CONNECTING ADJUSTMENT ASSEMBLY

CROSS-REFERENCE TO RELATED APPLICATIONS

This Application claims priority to U.S. Provisional Application Ser. No. 61/561,432, same title herewith, filed on Nov. 18, 2011, which is incorporated in its entirety herein by reference.

BACKGROUND

Fall protection assemblies that include climbing straps are often used by utility workers when climbing up utility poles. The climbing straps can include a first strap that is placed around an outer portion of the pole to be climbed and an inner strap that is positioned around an inner portion of the pole to be climbed. If a fall event occurs, the straps cinch up on the pole to limit the distance of the fall. The straps are connected together via connecting members. The ability to loosen and tighten the straps around the pole to position the straps as the worker climbs or descends the pole is an important function for a fall protection assembly. The connectors should aid in the loosening and tightening functions of the straps.

For the reasons stated above and for other reasons stated below which will become apparent to those skilled in the art upon reading and understanding the present specification, there is a need in the art for connecting members that provide effective and efficient means for connecting straps and loosening and tightening straps.

SUMMARY OF INVENTION

The above-mentioned problems of current systems are addressed by embodiments of the present invention and will be understood by reading and studying the following specification. The following summary is made by way of example and not by way of limitation. It is merely provided to aid the reader in understanding some of the aspects of the invention.

In one embodiment, a back plate assembly is provided that includes a body and a roller. The body has a first side and an opposed second side. The body further has a first edge and an opposed second edge that defines the length of the body. The body also has a third edge and an opposed fourth edge that define a width of the body. The body, still further, has a groove in the second side that passes along the width of the body. The roller is rotationally coupled proximate the second edge of the body.

In another embodiment, a connecting adjustment assembly is provided. The connecting assembly includes a back plate assembly and a sliding engagement member. The back plate assembly includes a body and a roller. The body has a first side and an opposed second side. The body further has a first edge and an opposed second edge that defines the length of the body. The body also has a third edge and an opposed fourth edge that defines a width of the body. The body still further has a groove in the second side that passes along the width of the body. The roller is rotationally coupled proximate the second edge of the body. The sliding engagement member includes a first post, a second post, a first side plate, a second side plate and a connection head. The first post is configured and arranged to be at least partially received within the groove of the body. The first post and the second post extend between the first plate and the second plate in a spaced fashion such that the passage is formed by the first post, the second post, the first side plate and the second side plate. The connecting head extends from the second post.

In still another embodiment, a fall protection assembly is provided, the fall protection assembly includes an outer strap, an inner strap of at least one connector adjustment assembly, a sliding engagement member, a connector and first, second and third carabiners. The at least one connector adjustment assembly includes a back plate assembly and a roller. The back plate assembly has a body. The body has a first side and an opposed second side. The body further has a first edge and an opposed second edge that defines the length of the body. The body also has a third edge and an opposed fourth edge that defines a width of the body. The body still further has a groove in the second side that passes along the width of the body. The roller is rotationally coupled proximate the second edge of the body. The sliding engagement member includes a first post and a connecting head. The first post that is configured and arranged to be at least partially received within the groove of the body such that the first post positions the first side of the back plate to engage the outer belt. The connecting head is coupled to the first post. The first carabiner engages the connecting head. The inner strap is selectively received within the first carabiner. The connector has a first portion that is statically coupled to the outer belt and a second side that is slidably coupled to the inner belt. The second carabiner is slidably coupled to the inner strap. Finally, the third carabiner is statically coupled to an end of the inner strap. The second and third carabiners are configured and arranged to couple the fall protection assembly to a safety harness of a user.

BRIEF DESCRIPTION OF THE DRAWINGS

The present invention can be more easily understood and further advantages and uses thereof will be more readily apparent, when considered in view of the detailed description and the following figures in which:

FIG. 5A is a front view of a back plate assembly of one embodiment of the present invention;

FIG. 5B is a top view of the back plate assembly of FIG. 5A;

FIG. 5C is a rear view of the back plate assembly of FIG. 5A;

FIG. 5D is a front perspective view of the back plate assembly of FIG. 5A;

FIG. 5E is a rear perspective view of the back plate assembly of FIG. 5A;

FIG. 5F is an another rear perspective view of the back plate assembly of FIG. 5A;

In accordance with common practice, the various described features are not drawn to scale but are drawn to emphasize specific features relevant to the present invention. Reference characters denote like elements throughout Figures and text.

DETAILED DESCRIPTION

In the following detailed description, reference is made to the accompanying drawings, which form a part hereof, and in which is shown by way of illustration specific embodiments in which the inventions may be practiced. These embodiments are described in sufficient detail to enable those skilled in the art to practice the invention, and it is to be understood that other embodiments may be utilized and that changes may be made without departing from the spirit and scope of the present invention. The following detailed description is, therefore, not to be taken in a limiting sense, and the scope of the present invention is defined only by the claims and equivalents thereof.

Figure 1A:
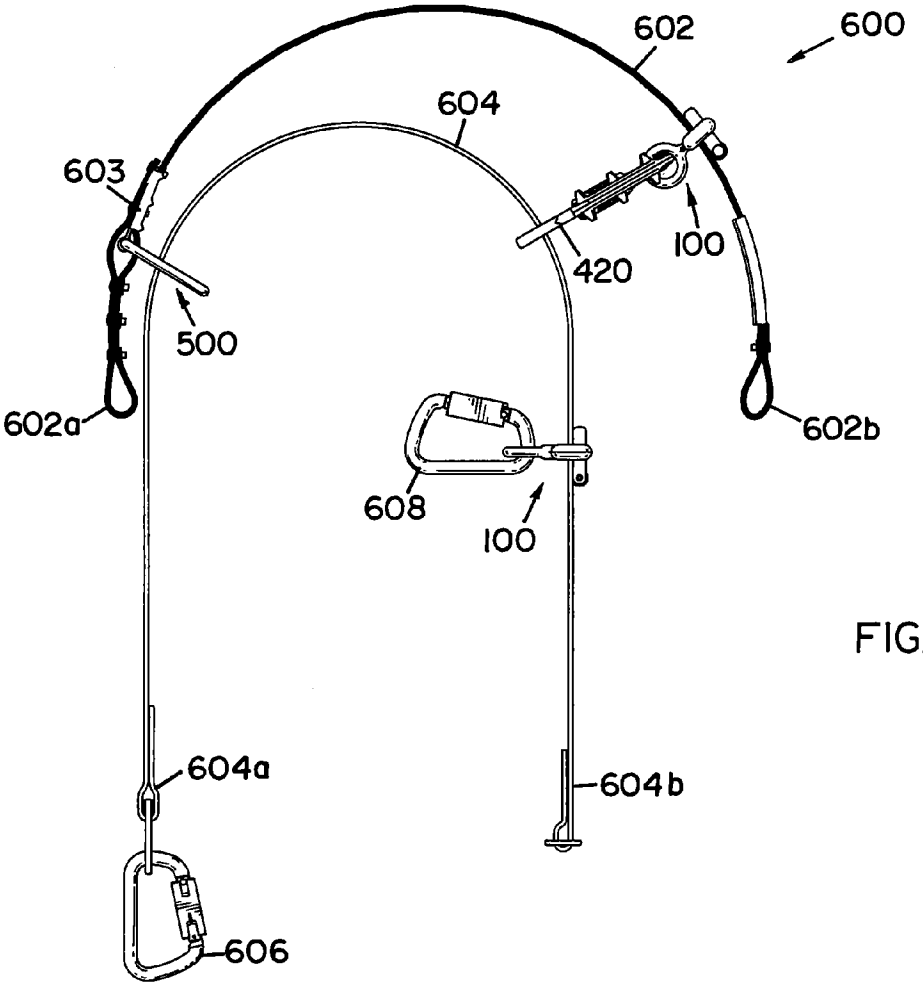
FIG. 1A is a top view of a fall protection assembly of one embodiment of the present invention.
Figure 1C:
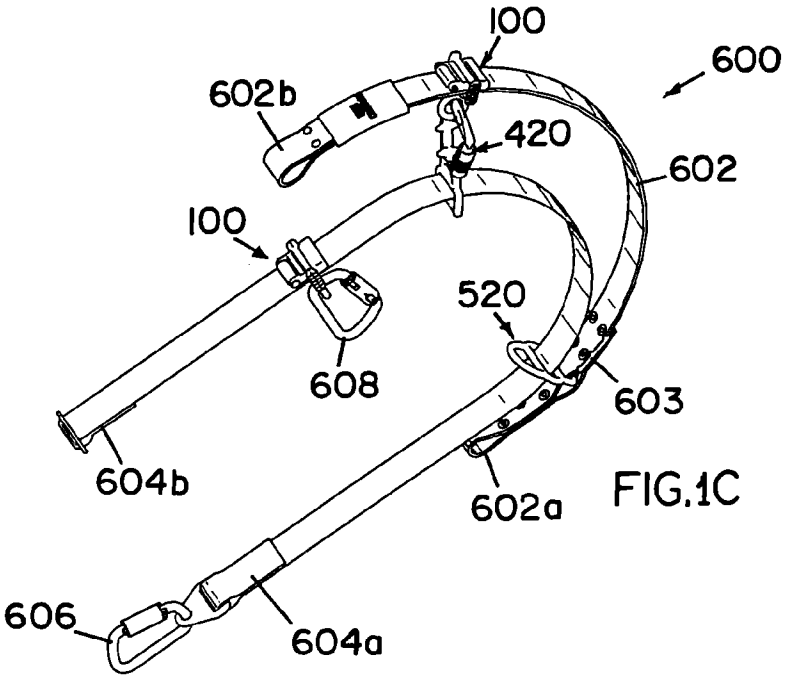
FIG. 1C is another side perspective view of the fall protection assembly of FIG. 1A.
Figure 1B:
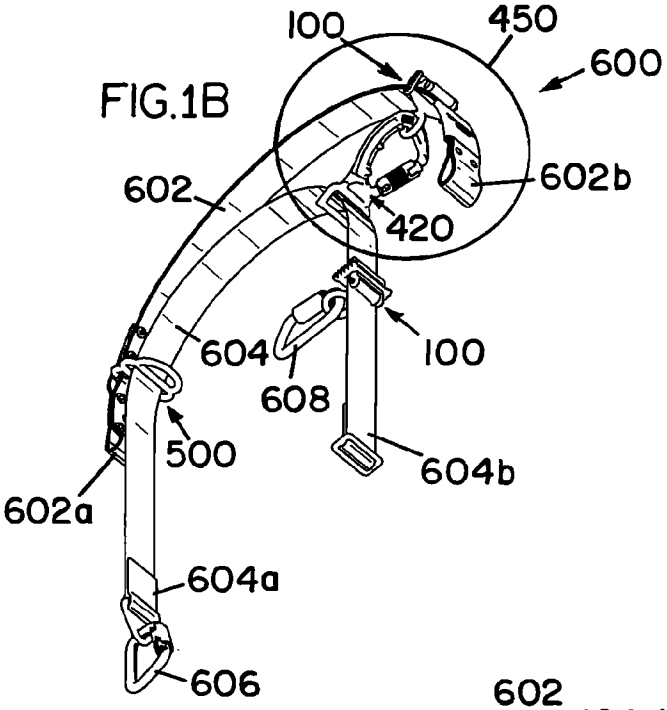
FIG. 1B is a side perspective view of the fall protection assembly of FIG. 1A.

Embodiments of the present invention provide connectors for a fall protection assembly or any type of assembly that requires the connection of two straps in an adjustment configuration. Referring to FIG. 1, a fall protection assembly 600 of embodiment is provided. The fall protection assembly is further illustrated in the perspective views of FIGS. 1B and 1C. In view of the Figures, the fall protection assembly 600 includes an outer strap 602 and an inner strap 604 in this embodiment. The outer strap 602 would be positioned around an outer portion of a pole to be climbed and the inner strap 604 would be positioned around an inner portion of the pole to be climbed. The purpose of the fall protection assembly 600 is to catch the user if a fall event occurs during climbing or descending the pole. In this embodiment, carabiners 606 and 608 would be coupled to respective connections on a safety harness of the worker. The fall protection assembly 600 of this embodiment includes connector 500. Detail of connector 500 is further discussed below. As FIGS. 1A-1B illustrate, the outer strap 602 of the fall prevention assembly 600 passes through a first passage 501 (shown in FIG. 7A) of connector 500 and holds the connector 500 in a static position in relation to the outer strap 602. In particular, the outer strap 602 has an end 602*a* that is folded back upon itself and held in place with fasteners 603. The folded back portion of the outer strap 602 is passed through the first passage 501 and the fasteners 603 hold the connector 500 in the static position in relation to the outer strap 602.

Figure 7B:
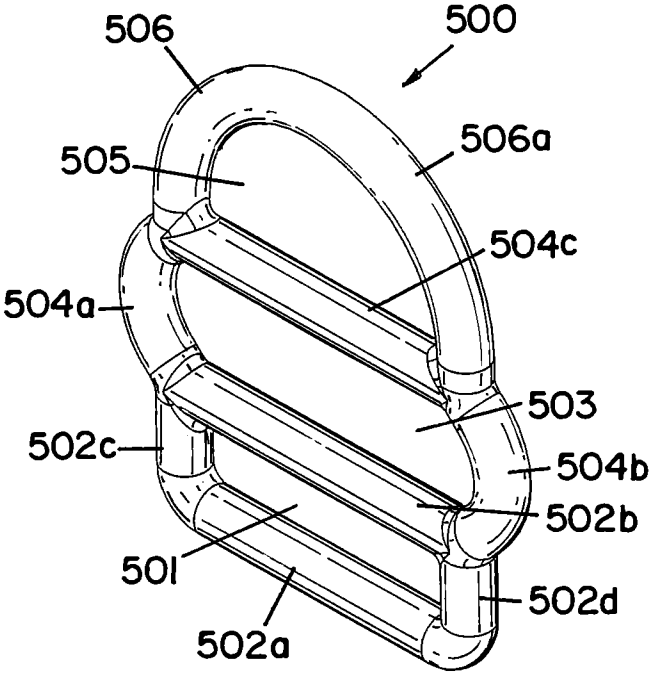
FIG. 7B is a side perceptive view of the connector of FIG. 7A.
Figure 7A:
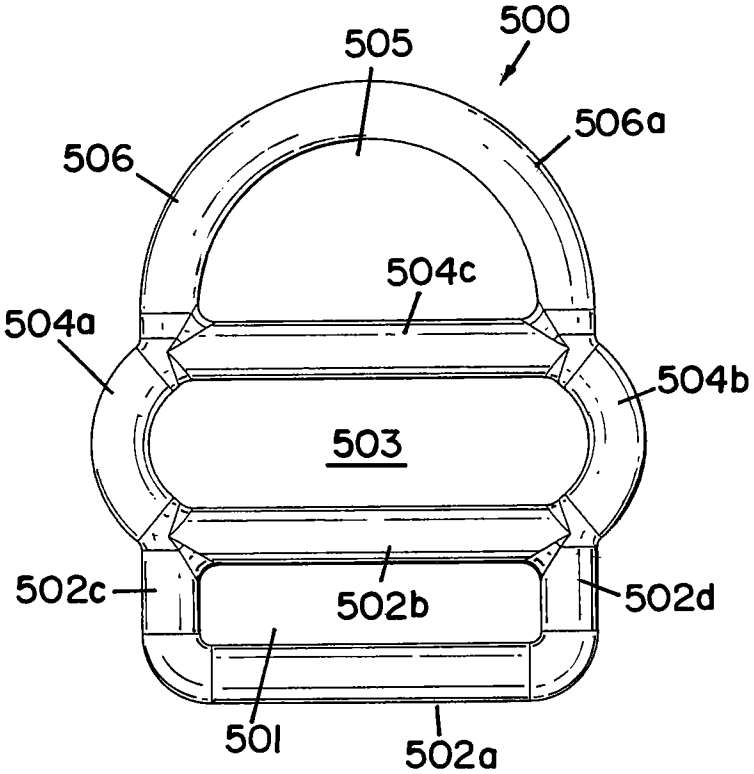
FIG. 7A is a front view a connector of one embodiment of the present invention.

The inner strap 604 is received in a second passage 503 (as shown in FIG. 7A) of the connector 500. In one embodiment, the inner strap 604 is a webbing. In another embodiment the inner strap is a belt. In still another embodiment, a rope is used for the inner strap 604. If a rope is used for the inner strap 604, the rope is passed through the third passage 505 (as shown in FIG. 7A) of the third section 506 of the connector 500. The third passage 505 is shaped to accommodate a rope (not shown) while the second passage 503 of the connector 500 is shaped to accommodate a strap 604. Hence, connector 500 is designed to accommodate an inner strap 604 which is either a strap or a rope.

Figure 1D:
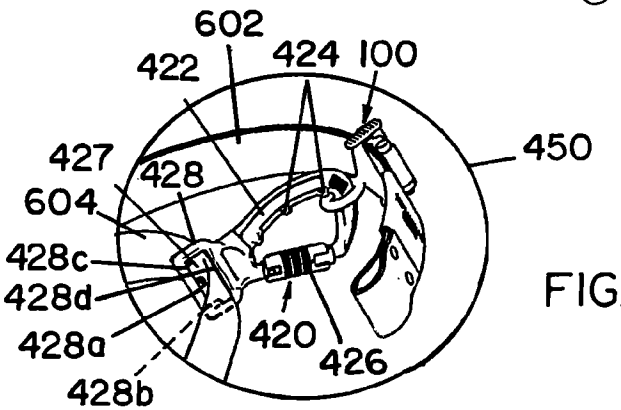
FIG. 1D is a close up view of a carabiner of an embodiment of the fall protection assembly of FIG. 1B.

The fall protection assembly 600 further illustrates carabiner 420 coupled to the connecting adjustment assembly 100. A close up view 450 of carabiner 420 is illustrated in FIG. 1D. The carabiner 420 of this embodiment includes a body 422 and a closed attaching portion 428. The body 422 includes a plurality of spikes 424 to engage a pole the user of the fall protection assembly 600 is climbing. The body 422 further includes an opening that is selectively closed via gate 426. In the embodiment of FIG. 1D, the gate 426 includes a rotating barrel which selectively locks the gate 426 in a closed position as known in the art. As illustrated, the inner strap 604 is passed through a passage 427 formed in the closed attaching portion 426 of the carabiner 420. As FIG. 1D further illustrates, the passage 427 is formed in the closed attaching portion 428 is shaped to accommodate the inner strap 604. The closed attaching portion 428 includes a first post 428*a* and a pair of side posts 428*b* and 428*c* that extend from opposing ends of the first post 428*a* in generally perpendicular fashion. The closed attaching portion 428 further includes a second post 428*d* that is coupled between ends of the side posts 428*b* and 428*c*. The first and second posts 428*a* and 428*d* and the pair of side posts 428*b* and 428*c* form the carabiner connecting passage 427. In the embodiment illustrated in FIG. 1D, connections between the second post 428*d* in the respective side posts 428*b* and 428*c* are rounded. As discussed above, in this embodiment, the passage 427 of the attaching portion 428 is shaped to accommodate a strap 604. In another embodiment (not shown), the attaching portion 428 is shaped to accommodate the shape of a rope used as the inner strap. Further, in other embodiments, separate passages for a strap and a rope can be formed in the closed attaching portion 428 of the carabiner 420 similar to passages 503 and 505 of connector 500 discussed above.

Figure 2:
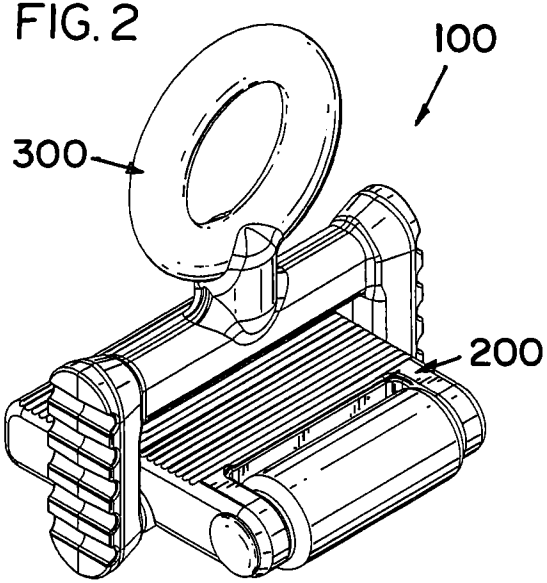
FIG. 2 is a side perspective view of a connecting adjustment assembly of one embodiment of the present invention.

Referring to FIG. 2, a side perspective view of an embodiment of a connecting adjustment assembly 100 is illustrated. The connecting adjustment assembly 100 includes a sliding engaging member 300 and a back plate assembly 200. The back plate assembly 200 is further illustrated in the adjustment assembly 100 unassembled view of FIG. 4 and the different views of the back plate assembly in FIGS. 5A through 5F. The back plate assembly 200 includes a body 202 having a first side 202*a* and a second side 202*b*. The surface of the first side 202*a* has a plurality of raised ridges 204 which are designed to increase friction between the body 202 and a strap, as is described further below. The body 202 further includes a first edge 202*c* and an opposed second edge 202*d* that defines a length of the body 202. The body 202 also includes a third edge 202*e* and an opposed fourth edge 202*f* that define the width of the body 202. The second side 202*b* of the body 202 includes a semi-circular groove 208 which is described in detail below.

Figure 4:
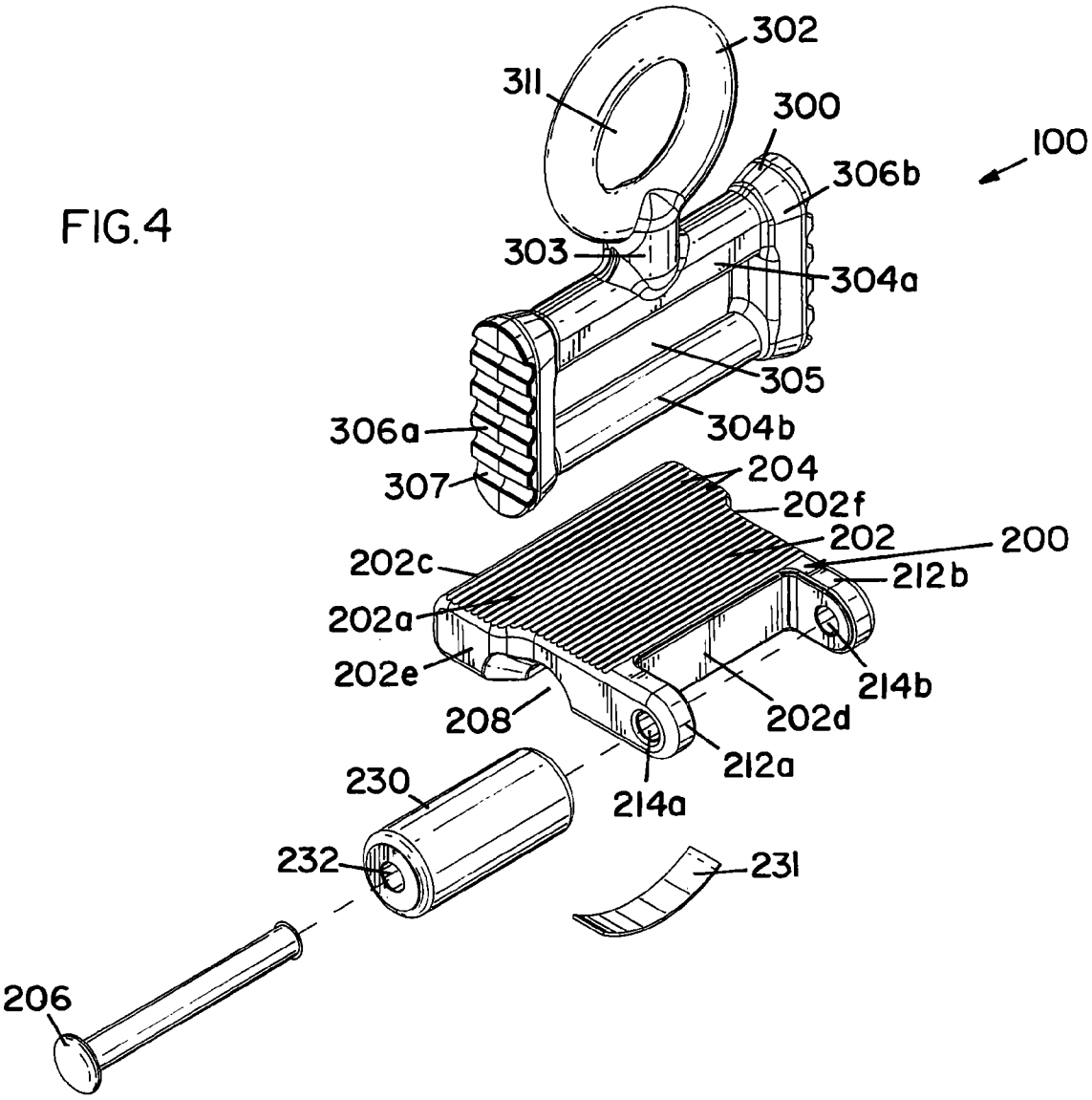
FIG. 4 is an unassembled side perspective view of the connecting adjustment assembly of FIG. 2.

As best illustrated in FIG. 4, the body 202 of the back plate assembly 200 includes a pair of ears 212*a* and 212*b* that extend out in the direction of the length of the body 202. In particular, ear 212*a* extends from the second edge 202*d* proximate the third edge 202*e* of the body 202 and ear 212*b* extends from the second edge 202*d* proximate the fourth edge 202*f* of the body 202 in such a manner that the first ear 212*a* is spaced a select distance from the second ear 212*b* along the second edge 202*d* of the body 202. The body 202 further includes a first section 203 and the second section 205 as illustrated in FIG. 5A. The first section 203 has a first width 210 and the second section 205 has a second width 211. As illustrated, the first width 210 is wider than the second width 211. Moreover, the first section 203 is positioned proximate the first edge 202*c* of the body 202 and the second section 205 is positioned proximate the second edge 202*d* of the body 202.

The groove 208 of the back plate assembly 200 is best illustrated in FIGS. 5B through 5F. As illustrated, the groove

208 extends through the body 202 along a parallel direction of the width of the body 202. In one embodiment, the groove 208 is not centered along the length of the body 202. In fact, in one embodiment, the groove is positioned closer to the second edge 202*d* than the first edge 202*c* of the body 202. The back plate assembly body 200 further includes flared openings 207*a* and 207*b* to the groove 208 in this embodiment that are best shown in FIG. 5E. The body further includes a central recess 216 that is positioned within the groove 208. The central recess 216 is configured to receive a biasing member 231 best illustrated in FIG. 4. The biasing member 231 in the groove 208 of the body 202 asserts a biasing force on a second post 304*b* of the sliding engaging member 300 as further discussed below. Also illustrated in FIGS. 5C, 5E and 5F are hollowed out cavities 251 and 253 which are positioned generally to run parallel to groove 208. Cavities 251 and 253 are used to reduce the weight of the body 202. FIG. 4 illustrates the body 202 without the roller 230. As illustrated, the first ear 212*a* and the second ear 212*b* include respective aligned ear passages 214*a* and 214*b*. The aligned ear passages 214*a* and 214*b* are further aligned with a central roller passage 232 of the roller 230. A fastener 206 is passed through the aligned ear passages 214*a* and 214*b* and the central roller passage 232 of the roller 230 and is configured to engage surfaces of the respective ears 212*a* and 212*b* to retain the roller 230 between the ears 212*a* and 212*b*. The roller 230 is designed to rotate about the fastener 206 to aid in the ease of adjustment of the fall prevention assembly.

Figure 6B:
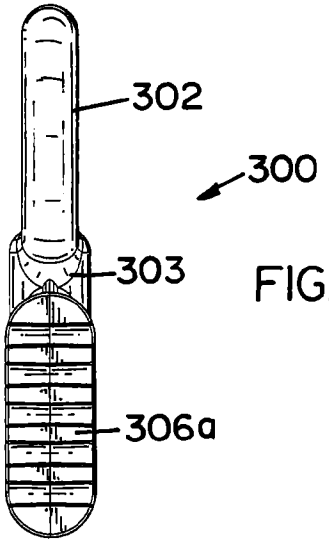
FIG. 6B is a top view of the sliding engagement member of FIG. 6A.
Figure 6C:
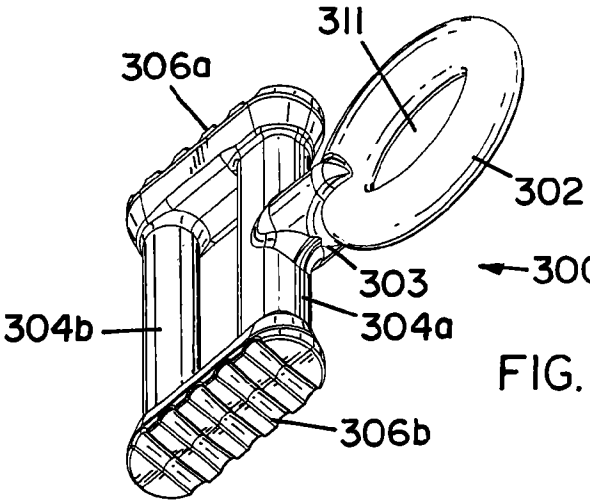
FIG. 6C is a front perspective view of the sliding engagement member of FIG. 6A.
Figure 6A:
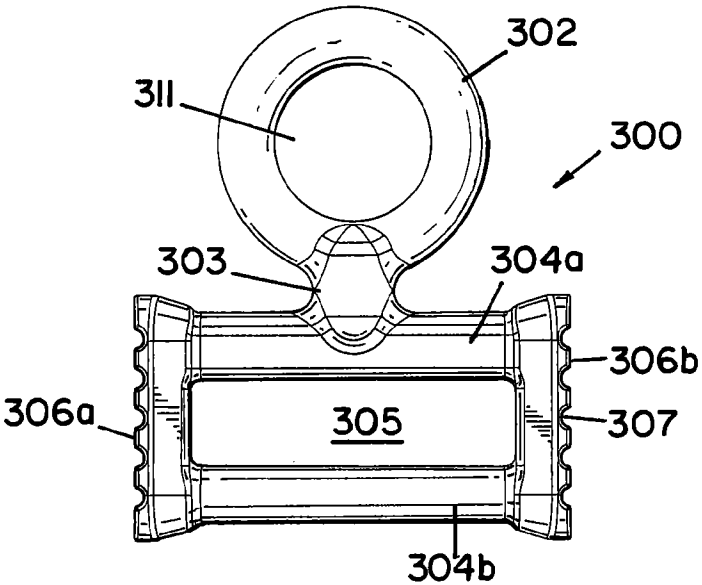
FIG. 6A is a front view of a sliding engagement member of one embodiment of the present invention.

The sliding engagement member 300 is illustrated in FIGS. 6A through 6C. The sliding engagement member 300 includes a first post 304*a* and a second post 304*b*. The first post 304*a* and the second post 304*b* are coupled between a first side plate 306*a* and a second side plate 306*b* in spaced configuration. The configuration provides a passage 305 in which the back plate assembly 200 and the belt 602 are received. The first and second side plates 306*a* and 306*b* each have an exterior surface that includes surface grooves 307 that aid in the grasping of the side plates 306*a* and 306*b* by a worker. Attached centrally to the first post 304*a* of the sliding engaging member 300 is a neck 303 that extends in an opposite direction from the second post 304*b*. A connector 302 further extends from the neck 303. The connector 302, in this embodiment, is circular shaped and is designed to engage a carabiner as discussed below.

Figure 3A:
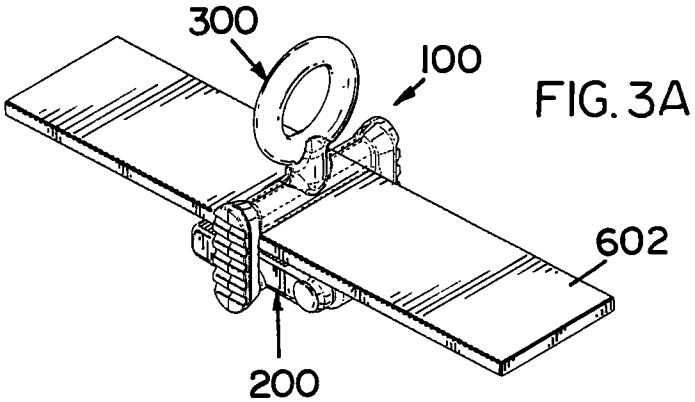
FIG. 3A is a side perspective view of the connecting adjustment assembly of FIG. 2 engaging a belt.
Figure 3B:
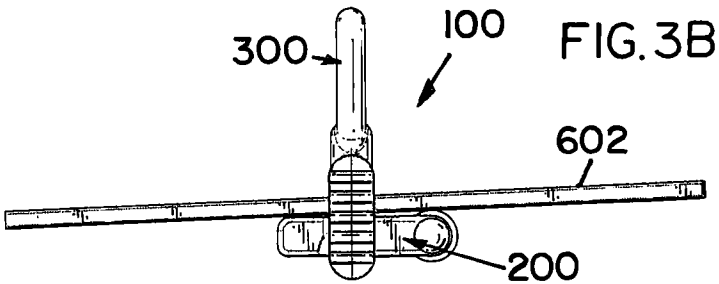
FIG. 3B is a side view of the connecting assembly of FIG. 2 engaging the belt.

Referring to FIGS. 3A and 3B, the connector adjustment assembly 100 is illustrated engaging a strap 602. As discussed above, the connector adjustment assembly 100 includes a sliding engagement member 300. As the Figures illustrate, the second post 304*b* of the siding engaging member 300 is received in the groove 208 of the body 202 of the back plate assembly 200. The first side 202*a* of the body 202, having the raised ridges 204, is positioned to engage the belt 602 to increase friction between the back plate member 200 and the belt 602. Moreover, the biasing member 231 in the groove of the back plate assembly 200 asserts a pressure on the second post 304*b* which pushes the first side of the body 202 into the strap 400 to further increase friction between the back plate assembly 200 and the strap 400. When it is desired to move the connector adjustment assembly 100 in relation to the belt, the body 202 of back plate assembly is pivoted, as discussed below, therein switching pressure from the raised ridges 204 to the roller 230.

FIGS. 1A through 1D illustrate the connecting adjustment assembly 100 being used in the fall protection assembly 600 as discussed above. In use, the outer strap 602 and the inner strap 604 would be snugly fit around a pole to be climbed. In this configuration the raised ridges 204 of the body 202 of the back plate member 200 are engaged with strap 602 to retain the fall protection assembly in its then current configuration. Also illustrated in the Figures, is carabiner 420 that is coupled to the connector head 302 of the sliding engagement member 300. When the user wants to move the strap 400 up the pole or down the pole the user grasps the side plates 306*a* and 306*b* of the sliding engagement member 300 and pulls the sliding engagement member 300 towards the roller 230. This action pivots the body 202 of the back plate assembly 200 therein switching pressure from the raised ridges tool 204 on the first side 202*a* of the body 202 that engages the strap 602, to the roller 230 that engages the strap 602. The connecting adjustment assembly 100 then moves easily about the roller 230 to loosen the fall protection assembly. To tighten, the fall protection assembly 600, the worker grasps an end 602*a* of the outer strap 602 and pulls the end 602*a* of outer strap 602 in a direction that is away from the body of the user. This movement bends the end 602*a* of the outer strap 602 in relation to the remainder of the strap 602 (because of the sliding engaging members 300 engagement with the inner strap 604) therein configuring a bend portion of the outer strap 602 to engage the roller 230 of the back plate assembly 200 which moves the back plate assembly 200 to tighten the straps 602 and 604 about the pole.

As discussed above, the inner strap 604 is coupled to a safety harness (not shown) of a user. In particular, carabiner 606, coupled to a first end 60*a* of the inner strap 604, is coupled to a portion of the safety harness and carabiner 608 is coupled to another portion of the safety harness. As illustrated in FIGS. 1A through 1C, carabiner 608 is adjustably coupled to the inner strap 604 via a second connector adjustment assembly 100. Hence in this embodiment, the fall protection assembly 600 includes two connector adjustment assemblies 100. When connected to a safety harness, the user's position (i.e. distance to the pole) is adjusted by the connector adjustment assembly 100. To adjust the fall protection assembly 600 to be closer to the pole, the user grasps an end 604*b* of the inner strap 604 and pulls the end 604*b* of inner strap 604 in a direction that is away from the body of the user. This movement bends the end 604*b* of the inner strap 602 in relation to the remainder of the strap 604 therein configuring a bend portion of the inner strap 604 that engages the roller 230 of the back plate assembly 200 which moves the back plate assembly 200 and carabiner 608 closer to the pole. To adjust the fall protection assembly 600 to be farther away from the pole, the user grasps the side plates 306*a* and 306*b* of the sliding engagement member 300 and pulls the sliding engagement member 300 towards the roller 230 of the back plate assembly. This action pivots the body 202 of the back plate assembly 200 therein switching pressure from the raised ridges tool 204 on the first side 202*a* of the body 202 that engages the belt 602, to the roller 230 that engages the belt 602. The second connecting adjustment assembly 100 then moves easily about the roller 230 to move the second connecting adjustment assembly 100 about the inner belt 604 to distance the user from the pole.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

The invention claimed is:

1. A back plate assembly comprising:

a body having a first side and an opposed second side, the body further having a first edge and an opposed second edge that defines the length of the body, the body also having a third edge and an opposed fourth edge defining a width of the body, the body still further having a groove in the second side that extends the width of the body from the third edge to the fourth edge, the groove configured and arranged to receive a portion of a post of a sliding engagement member; and a roller rotationally coupled proximate the second edge of the body, the roller having a length and diameter, the roller having a longitudinal axis that extends along the length of the roller, the longitudinal axis of the roller further positioned parallel to the groove.

2. The back plate assembly of claim 1, further comprising:

a pair of spaced ears extending from the second edge of the body, each ear having an ear passage, the ear passages of the ears being aligned;

the roller positioned between the pair of spaced ears, the roller having a central roller passage that is aligned with the ear passages of the pair of ears; and a fastener passing through the ear passages and the central roller passage to rotationally couple the roller to the body.

3. The back plate assembly of claim 1, wherein the first side of the body includes a plurality of ridges.

4. The back plate assembly of claim 1, comprising:

the body further having a first flared opening to the groove in the third edge and a second flared opening to the groove in the fourth edge.

5. The back plate assembly of claim 1, further wherein, the body having a first section and a second section, the first section positioned proximate the first edge of the body and the second section positioned proximate the second edge of the body, the first section of the body having a first width and the second section having a different second width.

6. The back plate assembly of claim 5, wherein the first width is greater than the second width.

7. The back plate assembly of claim 1, further comprising:

the body further having a central recess located within the groove; and a biasing member received within the central recess.

8. The back plate assembly of claim 1, wherein the groove is located closer to the second edge of the body than the first edge of the body.

9. A fall protection assembly comprising:

an outer strap;

an inner strap;

at least one connector adjustment assembly including, a back plate assembly having a body, the body having a first side and an opposed second side, the body further having a first edge and an opposed second edge that defines the length of the body, the body also having a third edge and an opposed fourth edge defining a width of the body, the body still further having a groove in the second side that passes along the width of the body, a roller rotationally coupled proximate the second edge of the body, and a sliding engagement member, the sliding engagement member including, a first post configured and arranged to be at least partially received within the groove of the body such that the first post positions the first side of the back plate to engage the outer belt, and a connecting head coupled to the first post;

a first carabiner engaging the connecting head, the inner strap selectively received within the first carabiner;

a connector having a first portion statically coupled to the outer belt and a second side slidably coupled to the inner belt;

a second carabiner slidably coupled to the inner strap; and a third carabiner statically coupled to an end of the inner strap, the second and third carabiners configured and arranged to couple the fall protection assembly to a safety harness of a user.

10. The fall protection assembly of claim 9, wherein the at least one connector adjustment assembly further comprises:

a pair of spaced ears extending from the second edge of the body, each ear having an ear passage, the ear passages of the ears being aligned;

a roller positioned between the pair of spaced ears, the roller having a central roller passage that is aligned with the ear passages of the pair of spaced ears; and a fastener passing through the ear passages and the central roller passage to rotationally couple the roller to the body.

11. The fall protection assembly of claim 9, wherein the at least one connector adjustment assembly further comprises:

the first side of the body includes a plurality of ridges; and the body further having a first flared opening in the third edge to the groove and a second flared opening in the fourth edge to the groove.

12. The fall protection assembly of claim 9, wherein the at least one connector adjustment assembly further comprises:

the body having a first section and a second section, the first section positioned proximate the first edge of the body and the second section positioned proximate the second edge of the body, the first section of the body having a first width and the second section having a different second width, the first width being greater than the second width.

13. The fall protection assembly of claim 9, wherein the at least one connector adjustment assembly further comprises:

the body further having a central recess located within the groove; and a biasing member received within the central recess.

14. The fall protection assembly of claim 9, wherein the sliding engagement member further comprises:

a second post;

a first side plate;

a second side plate, the first post and the second post extending between the first plate and the second plate in a spaced fashion such that the passage is formed by the first post, the second post, the first side plate and the second side plate, the outer belt passing through the formed passage; and the connecting head extending from the second post.

15. The fall protection assembly of claim 9, wherein the connector further comprises:

a first section having a generally rectangular shape;

a second section coupled to the first section, the second section having generally a rounded rectangular shape; and a third section coupled to the second section, the third section having generally a half circular shape.

16. The fall protection assembly of claim 9, wherein the first carabiner further comprises:

a body having an opening;

a gate to selectively close the opening;

a plurality of spikes positioned along the body;

a closed attaching portion coupled to the body, the closed attaching portion having at least one passage shaped to accept a shape of a strap.

* * * * *